United States Patent [19]

Lamberty et al.

[11] Patent Number: 4,870,426

[45] Date of Patent: Sep. 26, 1989

[54] DUAL BAND ANTENNA ELEMENT

[75] Inventors: Bernard J. Lamberty, Kent; Luis L. Oh, Seattle, both of Wash.

[73] Assignee: The Boeing Company, Seattle, Wash.

[21] Appl. No.: 234,636

[22] Filed: Aug. 22, 1988

[51] Int. Cl.[4] ..... H01Q 5/00; H01Q 13/00

[52] U.S. Cl. ..... 343/727; 343/772; 343/786

[58] Field of Search ..... 343/705, 725, 727, 772, 343/773, 774, 776, 786

[56] References Cited

U.S. PATENT DOCUMENTS

| | | | |
|---|---|---|---|
| 2,718,592 | 9/1955 | Smith . | |
| 2,726,388 | 12/1955 | Kandoian et al. | 343/774 |
| 2,755,467 | 7/1956 | Eyges | 343/844 |
| 2,820,965 | 1/1958 | Sichak | 343/756 |
| 2,946,055 | 7/1960 | Faflick | 343/727 |
| 3,205,499 | 9/1965 | Raburn | 343/730 |
| 3,508,277 | 4/1970 | Ware et al. | 343/786 |
| 3,623,111 | 11/1971 | Provencher et al. | 343/727 |
| 3,623,112 | 11/1971 | Rupp et al. | 343/727 |
| 3,680,138 | 7/1972 | Wheeler | 343/756 |
| 3,818,490 | 6/1974 | Leahy | 343/727 |
| 3,882,505 | 5/1975 | Mailloux | 343/727 |
| 3,938,159 | 2/1976 | Ajioka et al. | 343/786 |
| 4,063,248 | 12/1977 | Debski et al. | 343/727 |
| 4,097,868 | 6/1978 | Borowick | 343/727 |
| 4,218,685 | 8/1980 | Ellis, Jr. | 343/727 |
| 4,309,709 | 1/1982 | Hill | 343/727 |
| 4,376,937 | 3/1983 | Cohen | 343/727 |
| 4,502,053 | 2/1985 | Dupressoir et al. | 343/727 |
| 4,623,894 | 11/1986 | Lee et al. | 343/700 MS |
| 4,689,627 | 8/1987 | Lee et al. | 342/373 |
| 4,740,795 | 4/1988 | Seavey | 343/772 |

OTHER PUBLICATIONS

Seavey, J., "Proper Feed Selection: First Step to Optimum System Performance", TRVO Technology.

*Primary Examiner*—Rolf Hille
*Assistant Examiner*—Doris J. Johnson
*Attorney, Agent, or Firm*—Indyk, Pojunas & Brady

[57] ABSTRACT

A radar antenna element comprises a lower band waveguide and an array of parallel, dual-polarized, higher band waveguides and dipoles mounted within or directly adjacent an aperture of the lower band waveguide. The lower band waveguide and each higher band waveguide have one cross-sectional dimension less than 0.5 wavelength. A choke section, tuned dielectric or absorber isolates signals of the higher band waveguides from signals of the lower band waveguide. An array of such radar antenna elements locates a radar target with lower band signals and tracks that target with higher band signals, for instance.

32 Claims, 10 Drawing Sheets

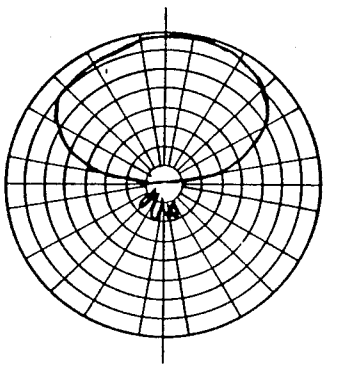
FIG. 6b
FIG. 6c
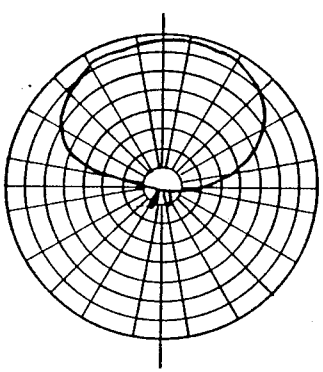
FIG. 6d
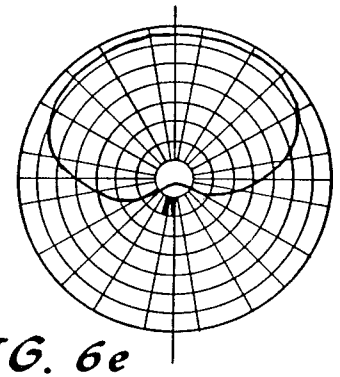
FIG. 6e
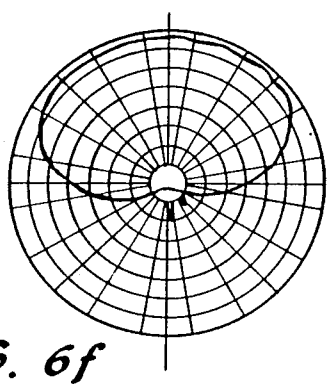
FIG. 6f
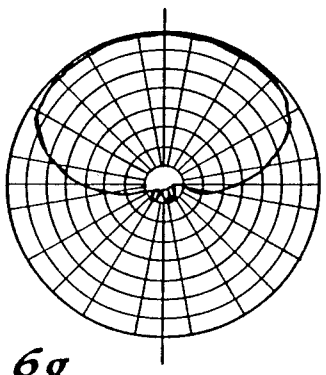
FIG. 6g

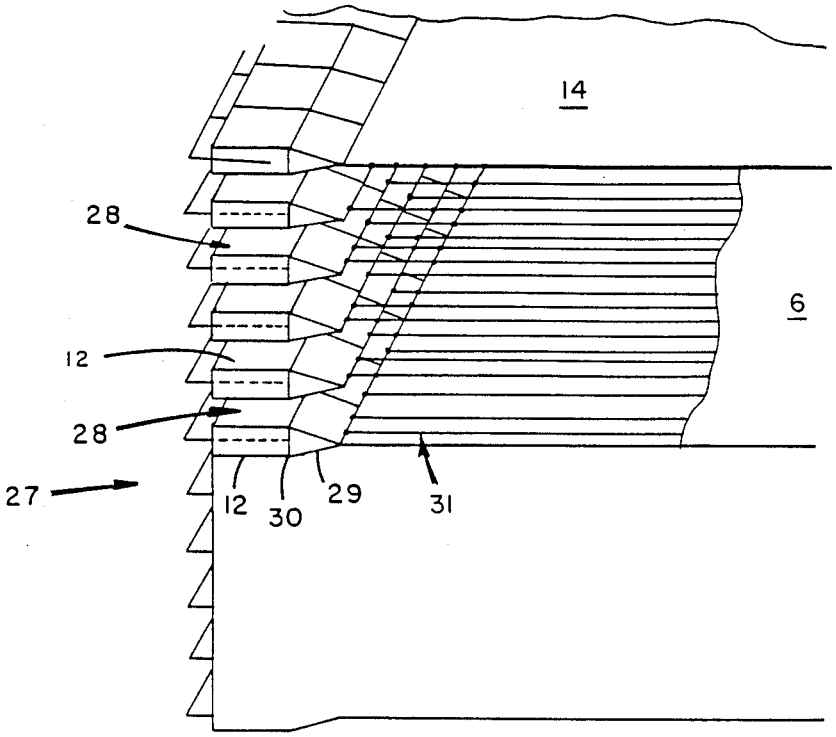
FIG. 10
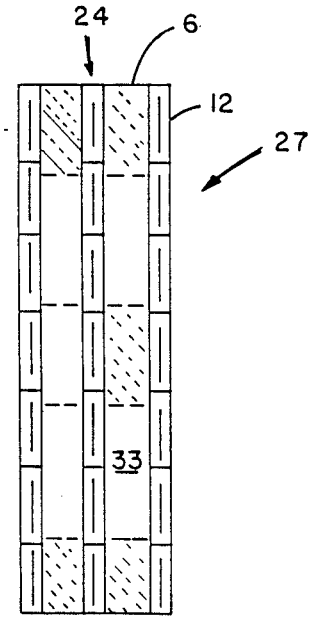
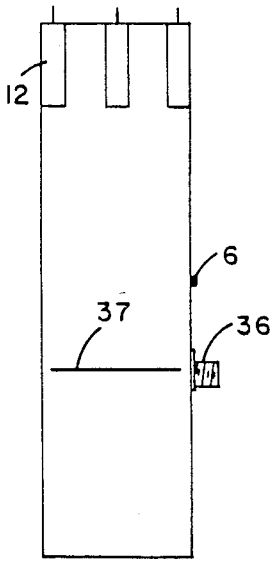
FIG. 13
FIG. 12

DUAL BAND ANTENNA ELEMENT

FIELD OF THE INVENTION

This invention relates to an antenna element. More specifically, this invention relates to an antenna element which operates in a dual frequency band.

BACKGROUND OF THE INVENTION

Phased array antennas comprise clusters of dipole energy radiators, for instance. Typically, these dipole radiators are arranged in a planar configuration. Each dipole radiator is driven by variable phase-shifting circuitry such that the array of dipole radiators sweeps a composite beam of radiated energy across a field of view. For example, if dipole radiators in an array are driven with a linear progression of phase shifts, the array of these radiators produces a phase front which travels at an angle to the array.

Phased array antenna systems are currently used in radar and communication systems and, for many applications, are preferred over conventional reflector antenna systems. Phased array antenna systems are capable of electronic scanning, are conformable to the surface of a vehicle carrying the system, such as an aircraft, and are compact. Phased array antenna systems are being considered for use aboard aircraft such as those used for the Airborne Warning And Control System (AWACS). A phased array antenna system would eliminate the current need for the large rotodome which sits atop an AWACS aircraft, and would thus eliminate the drag on the aircraft that the rotodome produces.

Radar targets are more readily visible in frequency bands where dimensions of targets are resonant. For many targets, this band includes the combined VHF and UHF band. (VHF is considered to extend approximately between 30 MHz and 300 MHz. UHF is considered to extend approximately between 300 MHz and 900 MHz.) For instance, a radar target such as a cruise missile having primary dimensions on the order of a small number of wavelengths in the VHF/UHF band has multiple resonances there and so reflects strong radar signals in that band. Maximum detection considerations tend to favor the low frequency end of this band. However, signal interference considerations tend to favor the UHF band which therefore becomes the band most favored. A horizontally polarized VHF/UHF band radar system more easily detects a radar target, such as a cruise missile or small aircraft, because such targets generally are oriented horizontally. However, a radar system must have a very large VHF/UHF band antenna to sufficiently track a radar target and provide high target resolution. Such a very large radar system aboard aircraft such as an AWACS aircraft would be impractical.

SUMMARY OF THE INVENTION

The invention concerns an antenna element which comprises a means for responding to a signal in a first frequency band comprising a waveguide having an aperture, and a means mounted at the aperture of the waveguide for responding to signals having dual polarization in a second frequency band higher than the first frequency band.

The preferred embodiment of this invention provides an antenna array system which is responsive to single polarization signals in the UHF band and dual polarization signals in the S-band (2.8–3.4 GHz). The UHF band is optimized for detection of a radar target and the S-band is optimized for resolution and tracking of a radar target. Both frequency bands are incorporated in a single, planar phased array to minimize the area in the aircraft which the antenna array occupies. Individual antenna elements of the planar phased array are packed densely to avoid grating lobes. The array of these phased antenna elements scans approximately 90 degrees in elevation and plus or minus 60 degrees in azimuth and covers at least a 10 percent bandwidth of each frequency band. A second embodiment has low frequency band at UHF and the high band frequency at the L-band (approximately 900–1400 MHZ). Many proof of concepts test were conducted of this embodiment.

BRIEF DESCRIPTION OF THE FIGURES

FIGS. 6*b*–6*g* illustrate radiation patterns for the dipole element of FIG. 6*a*.

FIG. 10 shows a side, cross-sectional view of a dual band antenna element according to this invention.

FIG. 12 shows a front view of another dual band antenna element according to this invention.

FIG. 13 shows a top view of the dual band antenna element of FIG. 12.

DETAILED DESCRIPTION OF THE INVENTION

Figure 1:
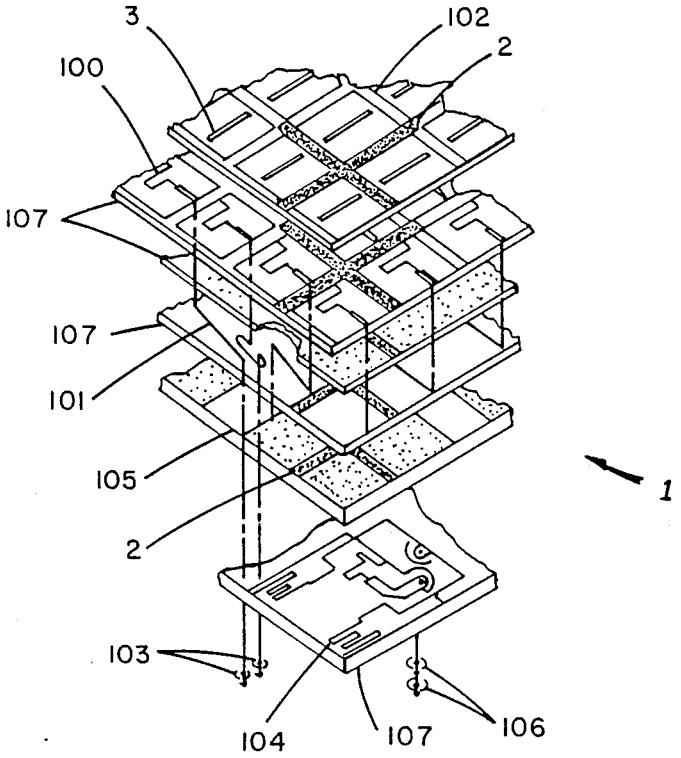
FIG. 1 shows a prior art cavity-backed slot, dual band antenna element.

FIG. 1 shows a prior art cavity-backed slot, dual band antenna element 1. Crossed slots 2 radiate S-band signals and slots 3 radiate X-band signals. This dual band antenna element 1 includes an x-band offset 100, an x-band feed line 101, x-band cavity walls 102, and x-band connectors 103. The element 1 also includes an s-band stripline feed 104, s-band cavity walls 105, and s-band connectors 106. The element also includes ground planes 107. However, it has been found that the circuitry for this antenna element 1 is extremely complex. This antenna element 1 has other disadvantages. Specifically, E- and H- plane patterns are significantly different at wide scan angles which skews polarization response at these angles, element spacing considerations dictate that the higher frequency band element have single polarization rather than the lower frequency band element, and separation between the higher and lower frequency bands is limited to no more than 5:1 and is more likely limited to 3:1.

Figure 2:
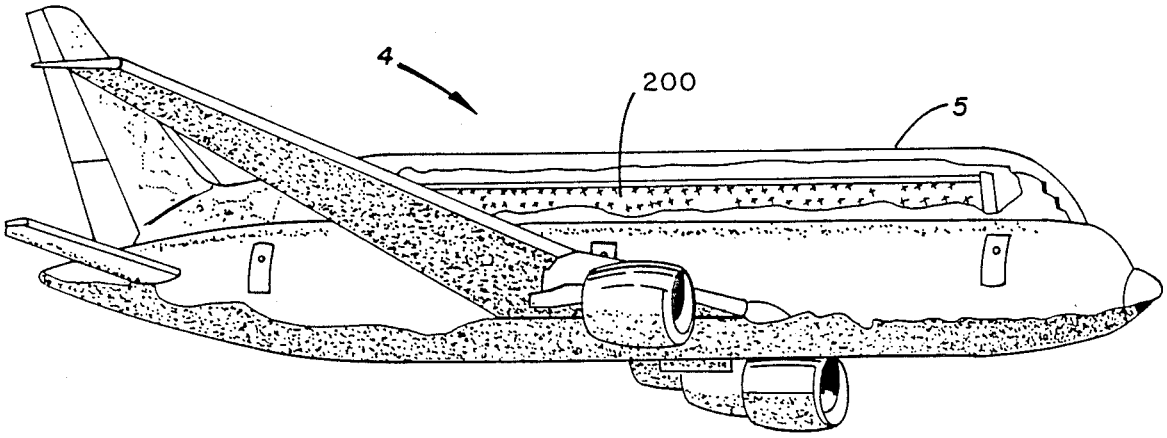
FIG. 2 shows an AWACS aircraft having a dorsal fin housing the planar phased array of this invention.

FIG. 2 shows an AWACS aircraft 4 having a planar phased array 200 according to this invention. This planar phased array replaces the conventional radar system used aboard AWACS aircraft, which had been housed in a rotodome atop such an aircraft. The aircraft 4 has a dorsal fin 5 for housing the planar phased array of this invention. The dorsal fin 5 can house two planar phased arrays, one on either side of the aircraft 4, which enable the radar system aboard the aircraft to view radar target scenes to both sides of the aircraft 4. This dorsal fin 5 is more aerodynamic than the rotodome mounted atop conventional AWACS aircraft, which allows the aircraft 4 to fly more efficiently.

Figure 3A:
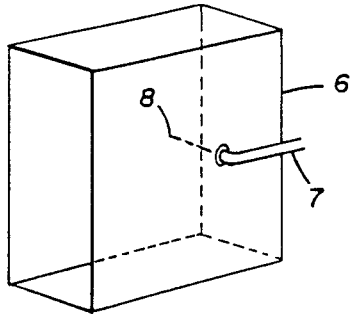
FIG. 3a PRIOR ART
FIG. 3*a* shows a low band element comprising an open-end waveguide.

FIG. 3*a* shows a low band element 6 comprising an open-end waveguide. A coaxial feed line 7 carries an alternating signal from a transmit-and-receive module, not shown, to a feed probe 8. A transmit-and-receive module produces a phase-delayed high power signal to the low band element 6 and receives a detected radar signal from the low band element 6. Such transmit-and-receive modules interface radar antennas with data processing and display equipment, and are known in the art. The feed probe 8 produces an electric field which propagates through the low band element 6. The low band element 6 is linearly polarized and is well known. According to a preferred embodiment, the low band element 6 is responsive to a horizontally polarized signal in the UHF band. The low band element 6 is responsive to this UHF signal and initially detects a radar target, for instance.

Figure 3B:
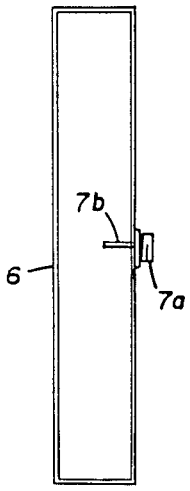
FIG. 3*b* shows a front view of a preferred low band element.
Figure 3C:
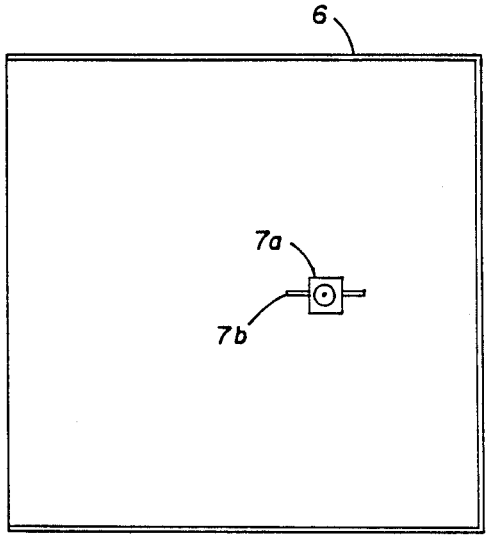
FIG. 3*c* shows a side view of the low band element of FIG. 3*b*.

FIG. 3*b* shows a front view of a preferred low band element of this invention. The low band element 6 is 4.7 inches wide in this embodiment. FIG. 3*c* shows a side view of the low band element of FIG. 3*b*. The low band element 6 is 16.0 inches deep and 15.6 inches high. A cable connector 7*a*, comprising a UHF input, is attached to a side of the low band element 6 and connects to a coaxial cable 7 of FIG. 3*a*, for instance. The cable connector 7*a* is positioned 6.0 inches from the rear of the waveguide.

Figure 3D:
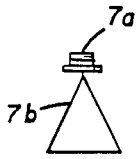
FIG. 3*d* shows details of a feed probe of the low band element of FIG. 3*b*.

FIG. 3*d* shows a feed probe 7*b* according to this embodiment. The feed probe 7*b* consists of a triangular plate soldered to the cable connector 7*a* to extend into the low band element 6. The triangular plate is 2.6 inches wide at its base and is 2.4 inches high. The triangular plate comprises a feed probe 7*b* of FIG. 3*a* and is positioned so the triangular plate is horizontal and perpendicular to the open end of the low band element 6. Such a feed probe has been found by the inventors to provide impedance matching.

Figure 4:
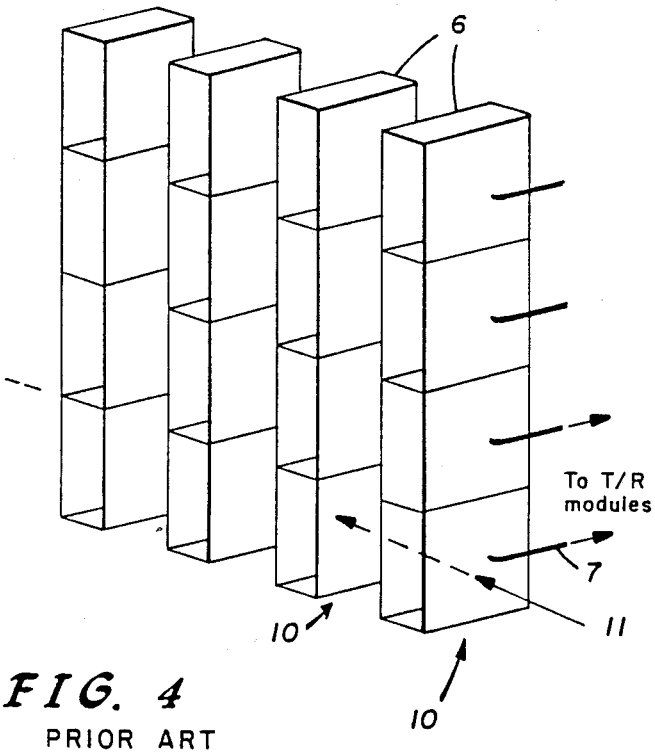
FIG. 4 PRIOR ART
FIG. 4 shows an array of low band elements of FIGS. 3*b*–3*d*.

FIG. 4 shows a planar array 9 of low band elements 6 of FIG. 3. This array 9 comprises columns 10 and rows 11 of low band elements 6. Each low band element 6 connects to a transmit-and-receive module, not shown. Arrays of such low band elements are well known. The low band element 6 is rectangular in cross-section and is oriented so the longer dimension of the rectangular cross-section is vertical. Such an orientation is necessary for airborne radar applications because scan angle is slightly constrained by the rectangular cross-section of the waveguide comprising the low band element 6. Such orientation also provides the horizontal polarization desired for detection of horizontally oriented targets.

Figure 5:
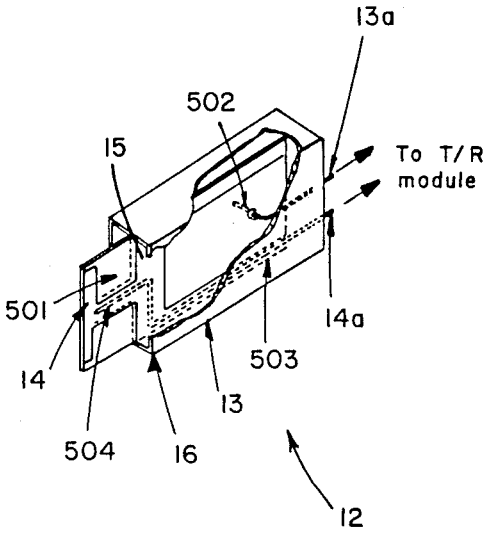
FIG. 5 PRIOR ART
FIG. 5 shows a high band element comprising a waveguide with a dipole.

FIG. 5 shows a hybrid, dual-polarized, high band element 12 comprising an open-end waveguide 13 with a dipole antenna 14. The dipole antenna 14 is excited through a strip line 15 located in the center of the waveguide 13. The dipole antenna 14 parallels the long-dimension of a waveguide aperture 16 and is mounted approximately $\frac{1}{4}$ wavelength in front of the waveguide aperture 16. The waveguide 13 is dimensioned to be beyond cut-off to the electric field of the dipole antenna 14 and serves as a ground plane. H-plane patterns of the waveguide 13 and E-plane patterns of such a dipole antenna 14 are relatively similar and E-plane patterns of the waveguide 13 and H-plane patterns of such a dipole antenna 14 are relatively similar. The waveguide 13 and the dipole antenna 14 are responsive to orthogonally polarized signals. Such high band elements 12 are well known. According to a preferred embodiment of this invention, each high band element 12 is responsive to a signal in the S-band (2.8–3.4 GHz). The high band element 12 is responsive to this dual-polarized, S-band signal and tracks a radar target with enhanced resolution, for instance. The element 12 includes a circuit board 501, a waveguide probe 502, a dipole feed line 503, and a balun 504.

Figure 6A:
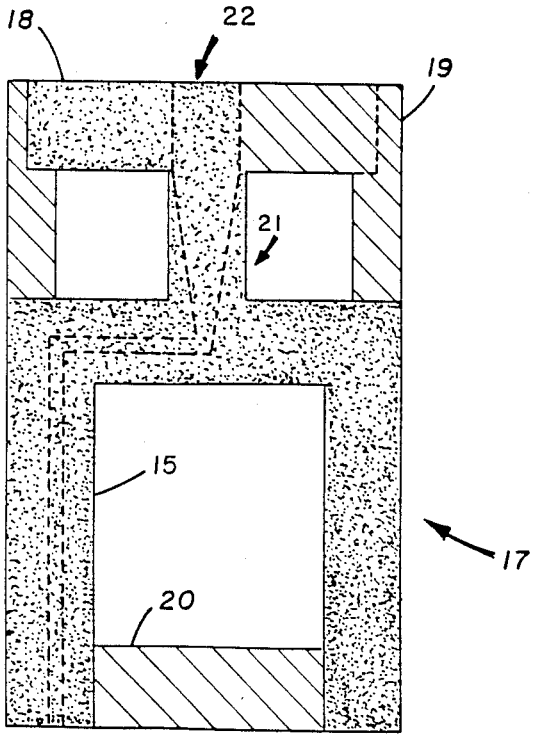
FIG. 6*a* shows details of a dipole element for impedance matching.

FIG. 6*a* shows details of a dipole element 17 for impedance matching according to this invention. The dipole element 17 replaces the dipole antenna 14 of FIG. 5. The dipole element 17 comprises two metal, conductive sections 18 and 19, one on each side of the dipole element 17. These metal sections 18 and 19 comprise a stripline feed. The dipole element 17 also comprises a dielectric section 20 and a balun section 21. The balun section 21 comprises a balance-to-unbalance section, which insures that each side of the dipole element 17 radiates in a balanced fashion despite the unbalanced nature of the stripline feed. Dipole antennas having metal sections, a dielectric section, and a balun section are known in the art.

However, the inventors have found that a dipole element having a tapered inner conductor 22 provides impedance matching. The tapered inner conductor 22 is etched between the two metal sections 18 and 19 during manufacture of the dipole element 17. The tapered inner conductor 22 and the two metal sections 18 and 19 physically connect with a coaxial connector, not shown. A coaxial connector electrically connects the tapered inner conductor 22 with an inner conductor of a coaxial feed line, such as 14*a* of FIG. 5, and the two metal sections 18 and 19 of the stripline feed with an outer conductor of a coaxial feed line 14*a*, for instance.

The inventors have found that the tapered conductor 22 matches the impedance of the dipole element 17 to that of the 50 ohm feed line 14*a* and reduces cross-polarization radiation in the waveguide component from −14 dB to less than −20 dB. A summary of the performance characteristics of a single hybrid element is shown in Table 1.

FIGS. 6b–6g illustrate radiation patterns for the dipole element 17 with a tapered inner conductor 22 of the high band element 12. For convenience of fabrication, elements were designed to operate near 1 GHz. However, equivalent results are obtainable at S-band by scaling dimensions of the elements, as is well known by antenna practitioners. FIGS. 6b–6d illustrate E-plane patterns for the dipole element 17 at 0.98 GHz, 1.03 GHz, and 1.08 GHz, respectively. FIGS. 6e–6g illustrate H-plane patterns for the dipole element 17 at 0.98 GHz, 1.03 GHz, and 1.08 GHz, respectively.

Figure 6J:
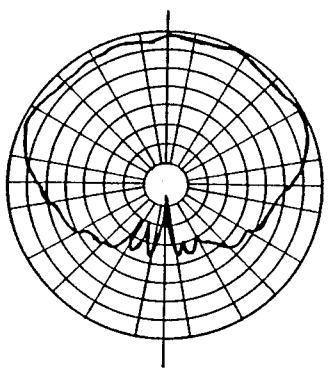
FIGS. 6*h*–6*m* illustrate radiation patterns for the waveguide of FIG. 5.
Figure 6I:
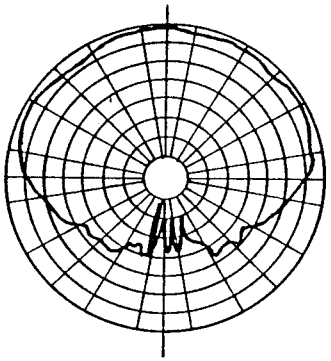
Figure 6H:
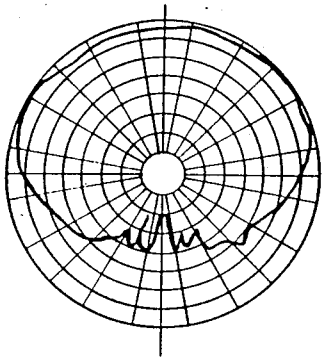
Figure 6M:
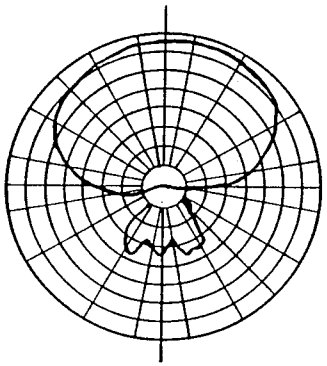
Figure 6L:
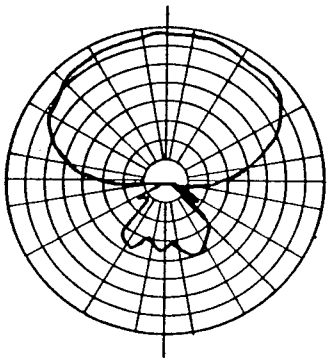
Figure 6K:
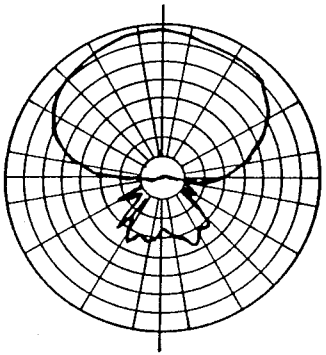

FIGS. 6h–6m illustrate radiation patterns for the waveguide 13 of the high band element 12. FIGS. 6h–6j illustrate E-plane patterns for the waveguide 13 at 0.98 GHz, 1.03 GHz, and 1.08 GHz, respectively. FIGS. 6k–6m illustrate H-plane patterns for the waveguide 13 at 0.98 GHz, 1.03 GHz, and 1.08 GHz, respectively.

E-plane waveguide patterns were very similar to H-plane dipole patterns and H-plane waveguide patterns were very similar to E-plane dipole patterns for this hybrid element, assuring equal polarization response over a wide range of scan angles. Also, both patterns were wider in the plane of the narrow dimension of the waveguide and narrower in the plane of the wide dimension of the waveguide. This corresponds to the different scan angle requirements for an airborne system (azimuth and elevation planes, respectively).

Figure 7:
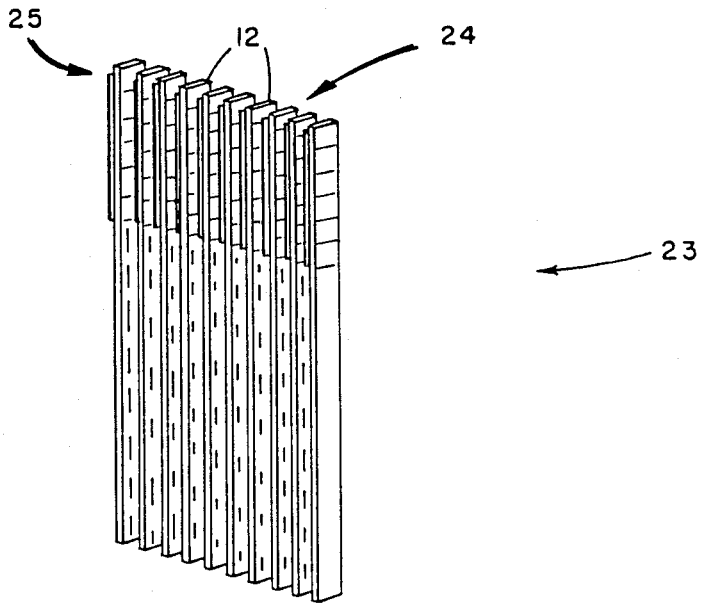
FIG. 7 shows an array of high band elements of FIG. 5.

FIG. 7 shows a planar array 23 of high band elements 12 of FIG. 5. The array 23 comprises columns 24 and rows 25 of high band elements 12. According to this invention, each column 24 is spaced a predetermined distance from an adjacent column 24, as discussed concerning FIGS. 12 and 13. The high band element 12 is rectangular in cross-section and is oriented so the longer dimension of the rectangular cross-section is vertical and parallels the orientation of the low band element 6.

Figure 8:
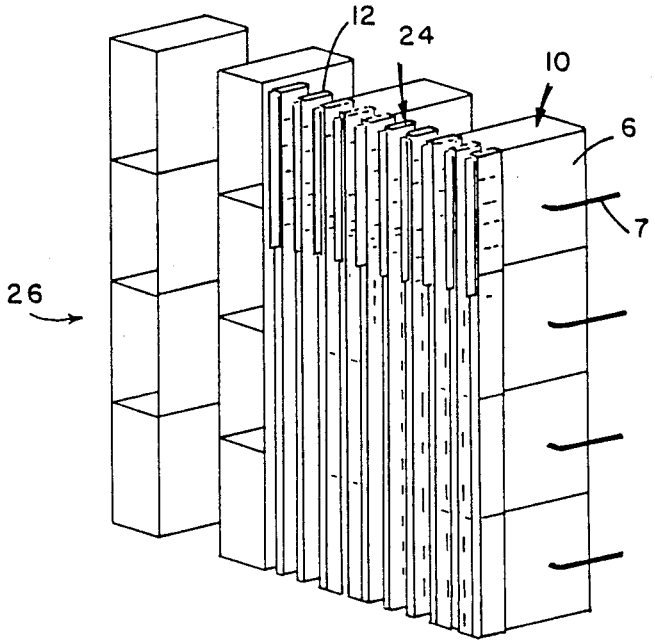
FIG. 8 shows a dual band array according to this invention.

FIG. 8 shows a dual band, planar array 26 according to this invention. Columns 10 of low band elements 6 and columns 24 of high band elements 12 interlace and comprise the dual band array 26. The dual band array 26 comprises a planar phased array which is responsive to both a horizontally polarized UHF band signal and a dual polarized S-band signal in a preferred embodiment. A processor, not shown, processes the signals of the two frequency bands in a radar system which detects and tracks a radar target. Such processors are well known.

Figure 9:
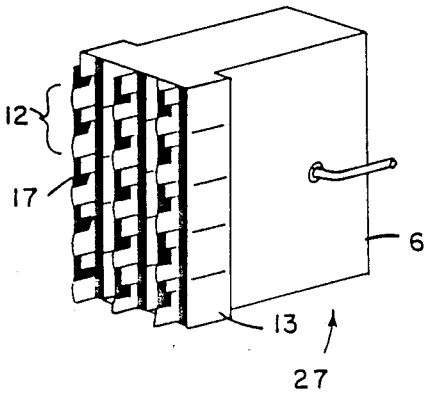
FIG. 9 shows a dual band antenna element of the array of FIG. 8.

FIG. 9 shows a dual band element 27 of the array 26 of FIG. 8. The dual band element 27 comprises a single low band element 6 and a number of high band elements 12 which are within and occupy the same geometry as the aperture of the low band element 6. The low band element 6 comprises an open-end waveguide and each high band element 12 comprises a waveguide having a dipole element with a tapered inner conductor 22 of FIG. 6a. The low band element 6 is responsive to a singular, horizontal polarization and each high band element 12 is responsive to dual, orthogonal polarizations. The waveguide 13 of the high band element 12 has a pattern of polarization parallel to the pattern of polarization of the low band element 6, but at a higher frequency. The polarization of the dipole element 17 of each high band element 12 is orthogonal to the polarization of the waveguide 13 of the high band element 12.

The high band element 12 is responsive to dual, orthogonal polarizations since a radar target is likely to have resonant dimensions at high band frequencies or highly reflecting surfaces in many orientation planes, not necessarily horizontal or vertical. Also, a selection can be made from these dual polarizations of the single polarization which most readily tracks a particular radar target. The dual polarized, high band element 12 provides very similar E-plane patterns of the dipole element 17 and H-plane patterns of the waveguide 13. The high band element 12 also provides very similar H-plane patterns of the dipole element 17 and E-plane patterns of the waveguide 13. The sum of the power received by the corresponding fields is, therefore, constant which insures equal polarization response by the high band element 12 even at wide scan angles. Also, the corresponding fields can be combined vectorally in quadrature to form a circularly polarized pattern. Such a combination has equal response at wide scan angles to any orientation of linearly polarized incident signals.

Conventional phased array elements are approximately 0.5 wavelengths square and occupy the entire space allocated to an element in a wide angle scanned array. When conventional elements are spaced greater than 0.5 wavelengths, power of radar signals can divide and undesirable grating lobes can occur at wide scan angles. Such undesirable grating lobes cause a radar system to produce ambiguous responses to a radar target and makes the system more prone to interference.

However, the dual-polarized, high band element 12 is significantly thinner than 0.5 wavelengths in one dimension. Because of this thinner dimension of the high band element 12, up to half the array space can be allocated to an element in another frequency band. In a preferred embodiment, the cross-section of the high band element 12 is approximately 0.56 wavelength wide and 0.17 wavelength high and so occupies less than half the area of a conventional 0.5 wavelength square element. The high band element 12 must be slightly wider than 0.5 wavelength in the wider dimension to avoid cutoff, which slightly constrains scan angle in that direction. For airborne radar applications the greater dimension of the high band element 12 must be oriented vertically.

As is well known by antenna practitioners, by filling the waveguide with dielectric material having a relative permittivity greater than 1, such as polytetrafluoroethylene, for instance, the width of a waveguide can be reduced to less than 0.5 wavelength in its operating band at some sacrifice in operating bandwidth. Such an option is practical for this invention.

FIG. 10 shows a cross-sectional, side view of a dual band element 27 according to this invention. The low band element 6 comprises a vertically oriented open-end waveguide having an aperture divided into septa 28 by rows 25 of high band elements 12. A tapered extension 29 on the rear of each high band element 12 transitions high band elements 12 into the larger, low band element 6. Radiant energy, to and from the low band element 6, flows over these tapered extensions 29 more gradually, and impedance transition is smoother. These tapered extensions 29 greatly reduce the reflection of signals produced by the low band elements 6, which would otherwise occur if the high frequency elements 12 had blunt back faces at 30.

In this configuration, high band transmit-and-receive modules, not shown, are housed in the tapered extensions 29. Two coaxial transmission lines, such as 13a and 14a of FIG. 5, carry signals of orthogonal polarity from the dipole element 17 and the waveguide 13 of the high band element 12 to the tapered extensions 29. Two additional coaxial transmission lines 31 from each transmit-and-receive module exit the array at the back wall of the low band element 6. The transmission lines lead to signal combiners, not shown. Such combiners perform a vector sum of electromagnetic energy one combiner for each polarization. Such combiners are used with conventional phased array antennas.

Figure 11:
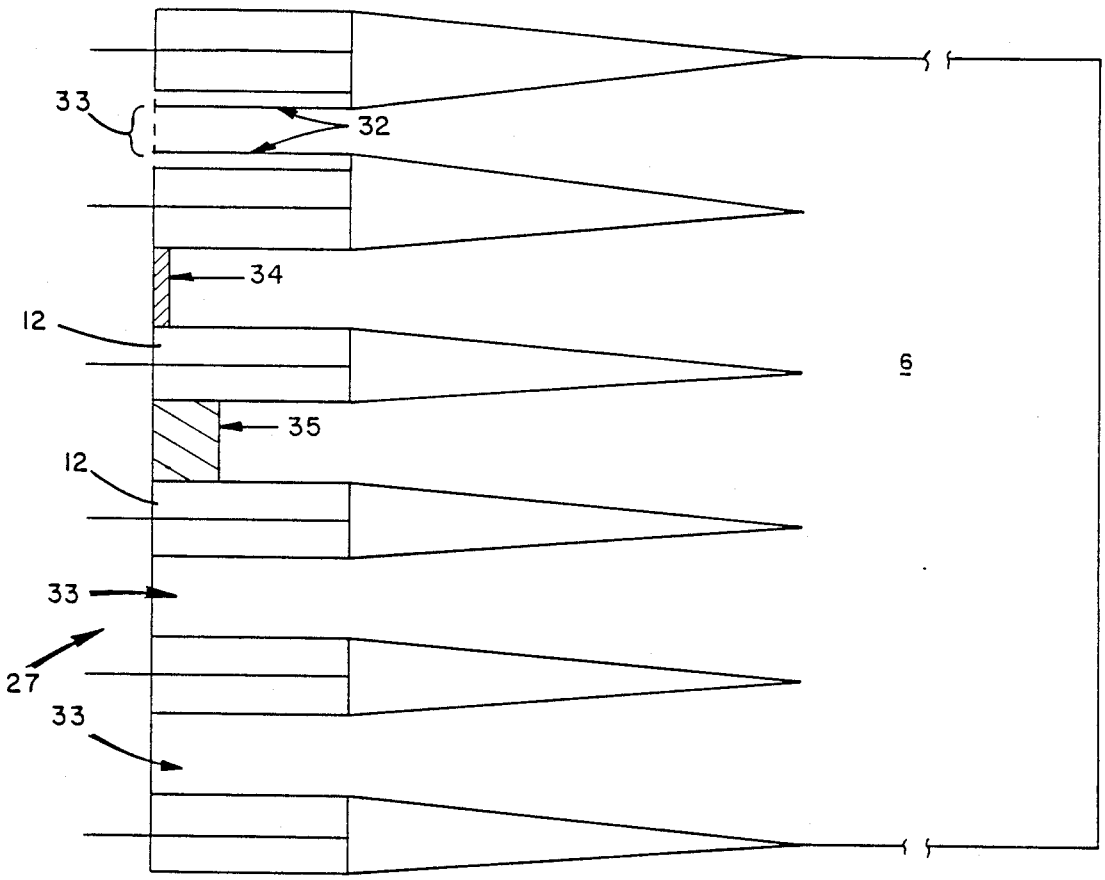
FIG. 11 shows a side cross-sectional view of a dual band antenna element having devices for electrically isolating high frequency elements from low frequency elements.

FIG. 11 shows a cross-sectional side view of the element 27 of FIG. 10, having three devices which can be separately used for isolating high band elements 12 from low band elements 6. (Coaxial transmission lines 31 in FIG. 10 are removed for clarity). To assure independent operation in the separate bands, the high band elements must be isolated from the low band element 6. Otherwise, fields of the high band elements 12 couple back into the low band element 6. Fields of the low band elements 6 cannot couple back to the high band elements 12 because of their dimensions, that is, high band elements are below cut-off at low band frequencies.

One isolating device comprises a choke section 32 which is tuned to the high frequency band. The choke section 32 forms an effective electrical short circuit across gaps 33 comprising septa between rows 25 of high frequency elements 12. Another isolating device comprises a thin wall 34 of material having a high dielectric constant, such as alumina, which is spread across and covers the gaps 33 between the rows 25, for instance. The thin wall 34 is tuned in thickness to present a high reflection coefficient at high frequencies, but is electrically very thin and therefore transparent in the low frequency band. Another indicating device comprises a thin layer of absorbing material 35 which is spread across and covers the gaps 33, for instance. This material 35 absorbs high frequency energy, thus isolating the high band elements from the low band elements 6, but is thin enough that low frequency performance is not significantly affected. Such an absorber is available from Emerson and Cumming, Inc., Eccosorb No. AN74.

FIG. 12 shows a front view of a vertically oriented dual band antenna element 27 which has been developed and tested by the inventors. The element 27 comprises a low band element 6 and an array of high band elements 12 interlaced in the aperture of the low band element 6. Each low band element 6 propagates a signal having a center band frequency of 436 MHz and a center band wavelength of 27.0 inches, approximately. Each low band element 6 is 15.6 inches high and 4.7 inches wide. At center band, height of each low band element is 0.58 times wavelength and width is 0.17 times wavelength, approximately. Each high band element 12 propagates a signal having a center band frequency of 3000 MHz and a wavelength of 3.93 inches, approximately. Each high band element 12 is 2.2 inches high and 0.7 inches wide and the columns 24 of these elements are set at spacings of 2.0 inches with 1.3 inches between each column. The spacings between columns 24 have been derived based on the signal wavelength of each high band element 12. Thus, at center band, the height of each high band element 12 is 0.56 times the wavelength, width is 0.18 times the wavelength and columns are set at spacings of 0.51 times the wavelength, approximately. The high band elements 12 are arranged in an array of three columns and seven rows in the aperture of the low band element 6, for instance.

FIG. 13 shows a top view of the dual band antenna element of FIG. 12. The low band element 6 is 16.0 inches deep. A coaxial feed line connector 36 and a feed probe 37 are mounted to the low band element 6.0 inches from the rear of the low band element 6. Each high band element 12 is 2.3 inches deep.

The inventors have tested the effects of high band elements 12 on the performance of a low band element 6 with the dual band antenna element of FIGS. 12 and 13. Such a test was conducted in which three rows 25 of seven high band elements 12 in the S-band range were contained within the aperture of a single low band element 6 in the UHF range as shown in FIGS. 12 and 13. The high band elements 12 were isolated from the low band element 6. A voltage standing wave ratio (VSWR) of less than 2.0:1 was achieved over a 7.3 percent band. A VSWR of less than 2.5:1 was achieved over a 23.0 percent band. These results were achieved using a high band element 12 having no tapered extension 29 or tapered inner conductor 22 to center impedance circles on 50 ohms. Use of a tapered extension and tapered inner conductor would further improve these results.

Figure 14:
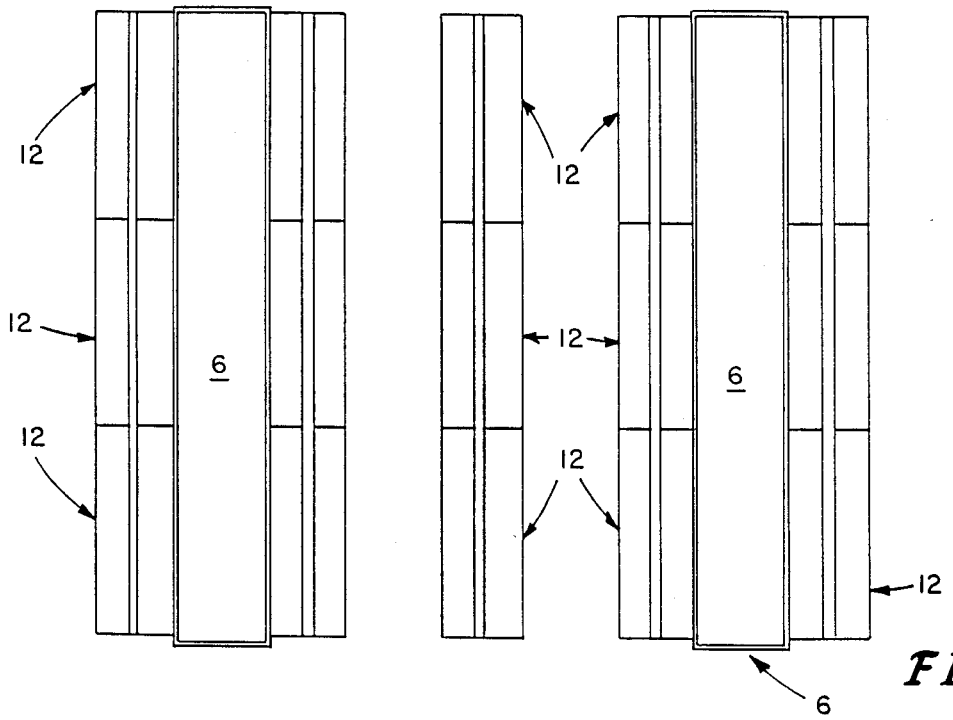
FIG. 14 shows the front view of still another dual band antenna element according to this invention.
Figure 15:
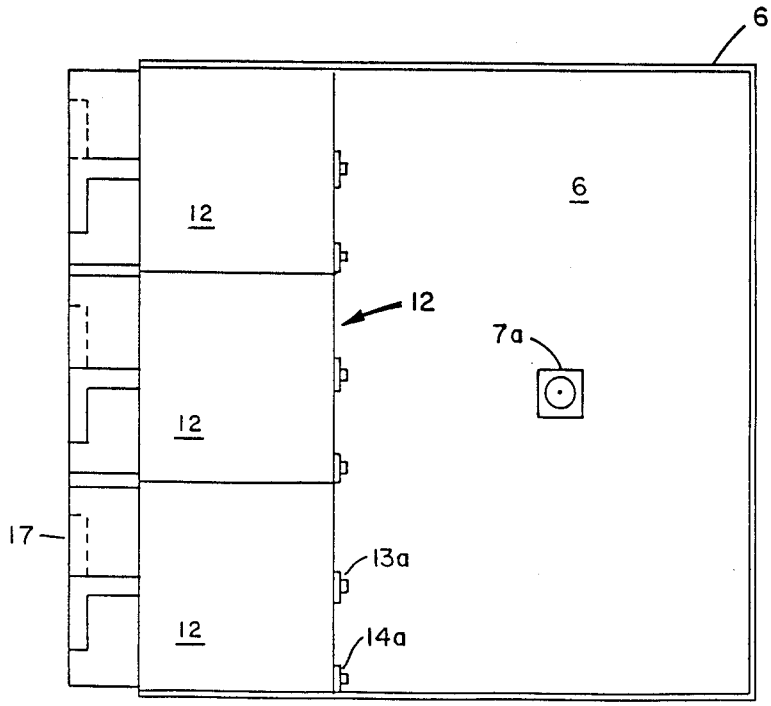
FIG. 15 shows a side view of the dual band element of FIG. 14.

FIG. 14 shows the front view and FIG. 15 the top view of another embodiment developed and tested by the inventors where the low band element 6 center band frequency is 436 MHZ and the high band element 12 center band frequency is 1300 MHZ (L-band). The low band element is only 2.5 inches wide or 0.09 wavelength at center band. The configuration of FIG. 14 and 15 permits interlacing of low band and high band apertures without entailing blockage of the low band element aperture by the high band element. The high band elements 12 are directly adjacent the low band element 6 in this embodiment. The high band elements 12 are 2.0 inches wide. The low band elements 6 are spaced such that their centers are 13.5 inches apart. The high band elements 12, directly adjacent the low band elements 6, are spaced such that their centers are 4.5 inches apart.

The cable connector **7*a* of FIG. 15 is 5.1 inches from the rear of the low band element 6. The low band element 6 is 15.5 inches high and 15.8 inches deep. The high band elements 12 are 15.0 inches high and 15.0 inches deep. The dipole elements 17 extend 1.2 inches beyond the aperture of the low band element 6**.

Figure 16A:
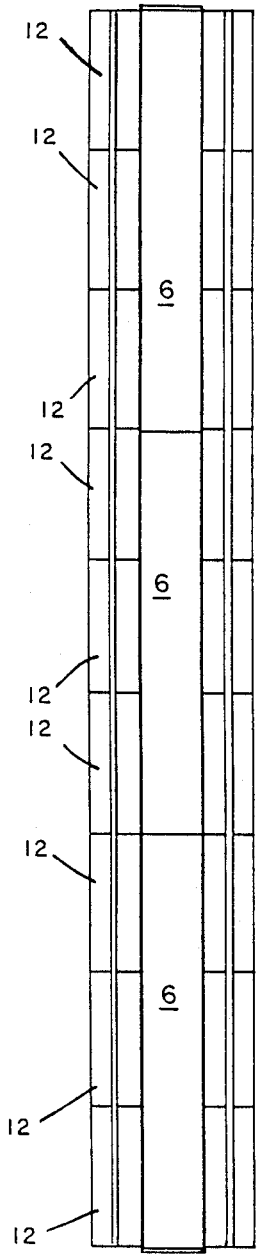
FIGS. 16*a* and 16*b* show front and side views of an array of 3 dual band elements of FIG. 14.
Figure 16B:
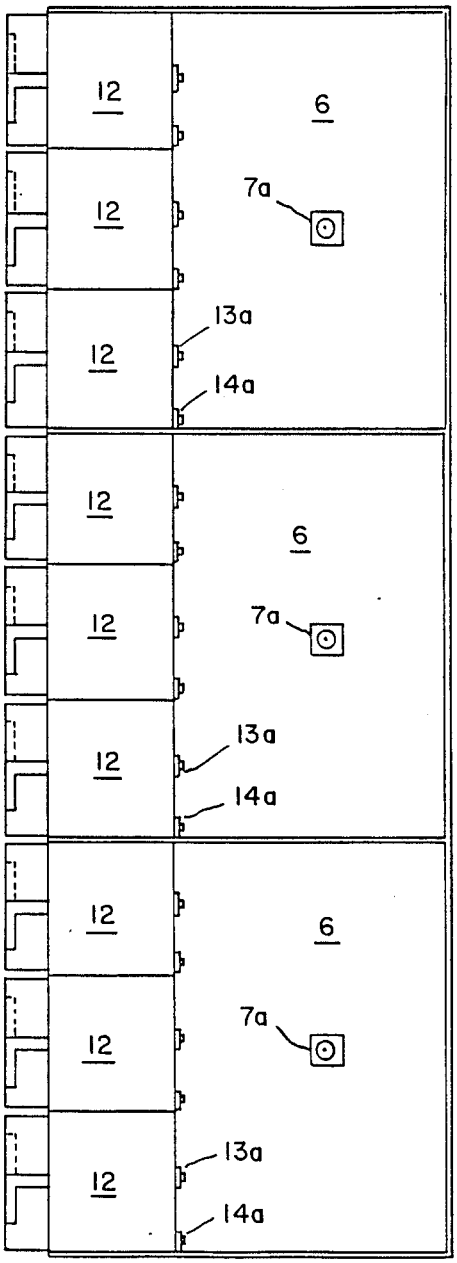

In the array embodiment of FIGS. 14 and 15 a VSWR of less than 2.0:1 was achieved over 21% bandwidth in the UHF element and over 28% and 17% bandwidths in the waveguide and dipole portions respectively of the L-band element. Since it is commonly known that the elements perform differently when combined in an array, an array of three UHF-L-band elements were assembled and tested. This array is shown in a front view in FIG. **16*a* and in a side view in FIG. 16*b*. Test results are summarized in Table 2 and illustrate the need for isolation devices such as those described earlier and shown in FIG. 11. Isolation devices such as those of FIG. 11 would be spread across the open end of each low band element 6 of FIG. 16*a*, as described concerning FIG. 11. The high band elements 12 of FIG. 16*a* are 2.0 inches wide and the low band elements 6 are 2.5 inches wide. The height and depth dimensions of the low band element 6 and the high band element 12 are the same as those of FIG. 15, as is the spacing of the cable connector 7*a*. However, in this embodiment, the dipole elements 17 extend 1.8 inches beyond the aperture of the low band element 6**.

These tests of the several embodiments demonstrate that the low band element 6 and the high band element 12 can be designed to cover at least a 10% bandwidth of their respective frequency bands for maximum efficient signal reception. This bandwidth is usually sufficient since a radar signal beam tends to skew at large scan angles at bandwidths greater than 10%. Transmit-and-receive modules could be shared by two arrays, one array on either side of the aircraft 4 of FIG. 2. Two transmission lines would connect each high band element 12 to centrally located transmit-and-receive modules, one line for each polarization as for instance shown in FIG. 10. The low band element has been shown capable of tolerating these band element has been shown capable of tolerating these transmission lines since they are longitudinal to the waveguide. The transmission lines effectively separate the low band element 6 into a number of thin, coupled waveguides. Transmission lines comprising a microstrip would more completely isolate the thin, high band waveguides 12. Separate waveguides could be fed in parallel without adversely affecting performance. Conductors, such as phase-shifting control lines and D.C. power lines, would run parallel to the transmission lines.

The low band element 6 can comprise fewer or more septa 28, depending on separation between the two frequency bands of operation. Band separation ratios ranging from less than 2:1 to greater than 10:1, including non-integer band separation ratios, are easily achievable. The waveguide component of the hybrid element or the low band element can comprise slots or cavity-backed slots rather than waveguides, which could permit a more compact configuration in the wide dimension of both elements.

The dimensions specified in inches concerning FIGS. 12, 13, 14, 15, 16*a*, and 16*b* serve as examples. The dimensions of the low band and high band elements change with signal frequency and corresponding wavelengths chosen for the low band and high band elements 6 and 12.

TABLE 1

Waveguide-Dipole Antenna

| (a) Waveguide Port | | 980 MHz | 1030 MHz | 1080 MHz |
|---|---|---|---|---|
| HPBW* | E | 157° | 156° | 157° |
| HPBW | H | 82° | 70° | 66° |
| X-POL | E | −20 dB | −22 dB | −22 dB |
| X-POL | H | −20 dB | −23 dB | −23 dB |
| VSWR | | 1.4 | 1.5 | 1.4 |
| **(b) Dipole Port** | | **980 MHz** | **1030 MHz** | **1080 MHz** |
| HPBW | H | 106° | 103° | 108° |
| HPBW | E | 69° | 68° | 66° |
| X-POL | H | −24 dB | −26 dB | −30 dB |
| X-POL | E | −26 dB | −32 dB | −27 dB |
| VSWR | | 1.7 | 1.5 | 1.5 |
| ISOLATION | | 32 dB | 45 dB | 37 dB |

*HPBW is Half Power Beamwidth;
X-POL is Crossed Polarization;
E is E-Plane;
H is H-Plane; and
VSWR is Voltage Standing Wave Ratio.

TABLE 2

Impedance and Isolation Between Antenna Elements in an Array.

| A. | L-Band Frequency Band (1235–1365 MHz) ELEMENTS* | ISOLATION, dB |
|---|---|---|
| | W/G 12.5 to W/G 12.14 | 11 to 22 |
| | W/G 12.6 to W/G 12.15 | 17 to 20 |
| | DIP 12.5 to DIP 12.14 | 17 to 20 |
| | DIP 12.6 to DIP 12.15 | 19 to 22 |
| | W/G 12.5 to UHF 6B | 13 to 24 |
| | W/G 12.6 to UHF 6B | 16 to 19 |
| | DIP 12.5 to UHF 6B | 33 to 53 |

TABLE 2-continued

Impedance and Isolation Between Antenna Elements in an Array.

| | | |
|---|---|---|
| | DIP 12.6 to UHF 6B | 30 to 48 |
| B. | UHF Frequency Band (377 to 462 MHz) ELEMENTS* | ISOLATION, dB |
| | UHF 6A to UHF 6B | 17 to 26 |
| | UHF 6A to UHF 6C | 26 to 42 |
| | UHF 6B to UHF 6C | 17 to 22 |
| | UHF 6B to W/G 12.5 | 36 to 45 |
| | UHF 6B to DIP 12.5 | 29 to 48 |
| 1. | IMPEDANCE BANDWIDTH FOR VSWR <2.0:1 | |
| | A. UHF ELEMENT | |
| | Center element - 16% | |
| | Edge element - 15% | |
| | B. L-BAND ELEMENT | |
| | Dipole - greater than 10% | |
| | Waveguide - greater than 10% | |

*W/G: L-BAND WAVEGUIDE ELEMENT
DIP: L-BAND DIPOLE ELEMENT
UHF: UHF WAVEGUIDE ELEMENT

We claim:

1. An antenna element comprising:

means for responding to a signal in a first frequency band comprising a first waveguide having a first aperture, and means mounted within the first aperture of the first waveguide for responding to a signal in a second frequency band higher than the first frequency band and having dual polarization aperture and a dipole element extending out of the second waveguide at the second aperture.

2. The antenna element of claim 1, the second waveguide comprising a means for responding to a signal in the second frequency band in a first polarization, and the dipole element comprising a means for responding to a signal in the second frequency band in a second polarization.

3. The antenna element of claim 2, comprising a means adjacent each second waveguide for preventing signals of the second frequency band from entering the first waveguide.

4. The antenna element of claim 3, the at least one second waveguide having a tapered extension opposite the second aperture, and which tapers away from the first aperture of the first waveguide.

5. The antenna element of claim 4, the at least one second waveguide comprising an array of second waveguides mounted within the first aperture of the first waveguide.

6. The antenna element of claim 5, the dipole element comprising a means for connecting to a first feed line and a means for impedance matching the dipole element to the first feed line.

7. The antenna element of claim 6, the dipole element comprising a dipole antenna having two metal sections, the means for impedance matching comprising a tapered conductor between the two metal sections of the dipole antenna, the first waveguide comprising a means for connecting to a second feed line and a means comprising a triangular plate for impedance matching the first waveguide to the second feed line.

8. The antenna element of claim 7, the first frequency band and the second frequency band comprising non-overlapping bands of frequencies.

9. The antenna element of claim 8, the means for preventing comprising a dielectric material mounted adjacent each second waveguide.

10. The antenna element of claim 8, the means for preventing comprising a choke mounted adjacent each second waveguide.

11. The antenna element of claim 8, the means for preventing comprising an electric field absorber mounted adjacent each second waveguide.

12. The antenna element of claim 8, the first waveguide and each second waveguide having rectangular cross-sections.

13. The antenna element of claim 12, the rectangular cross-sections of the first waveguide and each second waveguide having one dimension greater than 0.5 wavelength and one dimension less than 0.5 wavelength.

14. The antenna element of claim 13, each second waveguide parallels the first waveguide and parallels the dipole element.

15. A planar phased array comprising:

means for responding to a first frequency band signal comprising an array of first rectangular waveguides each having a first aperture with one cross-sectional dimension less than 0.5 wavelength, and means mounted within the first aperture of each first waveguide for responding to a second frequency band signal higher than the first frequency band signal and having dual polarization, comprising an array of second rectangular waveguides parallel to the first rectangular waveguides each second waveguide having:

a second aperture with one cross-sectional dimension less than 0.5 wavelength;

a tapered extension opposite the second aperture;

a dipole element extending out of the second waveguide at the second aperture, the dipole element comprising two meral sections and a means comprising a tapered conductor between the two metal sections for impedance matching the dipole element to a feed line; and a means adjacent the second waveguide for preventing the second frequency band signals from entering the first waveguide.

16. A planar phased array comprising:

means for responding to a first frequency band signal comprising an array of first rectangular waveguides each having a first aperture with one cross-sectional dimension less than 0.5 wavelength, and means mounted directly adjacent the first aperture of each first waveguide for responding to a second frequency band signal higher than the first frequency band having dual polarization, comprising an array of second rectangular waveguides parallel to the first rectangular waveguides each second waveguide having:

a second aperture with one cross-sectional dimension less than 0.5 wavelength;

a dipole element extending out of the second waveguide at the second aperture, the dipole element comprising two metal sections and a means comprising a tapered conductor between the two metal sections for impedance matching the dipole element to a feed line; and a means adjacent the second waveguide for isolating the first frequency band signals from the second frequency band signals.

17. An antenna element comprising:

means for responding to a signal in a first frequency band having dual polarization comprising a first waveguide having a first aperture, and means comprising an array of second waveguide mounted within the first aperture of the first waveguide for responding to a signal in a second frequency band higher than the first frequency band and having dual polarization.

18. The antenna element of claim 17, the means for responding to a signal in a second frequency band having dual polarization being mounted directly adjacent the first aperture of the first waveguide.

19. The antenna element of claim 18, the means for responding to a signal in a second frequency band comprising at least one second waveguide having a second aperture and a dipole element extending out of the second waveguide at the second aperture.

20. The antenna element of claim 19, the second waveguide comprising a means for responding to a signal in the second frequency band in a first polarization, and the dipole element comprising a means for responding to a signal in the second frequency band in a second polarization.

21. The antenna element of claim 20, comprising a means adjacent each second waveguide for isolating signals in the second frequency band from signals in the first frequency band.

22. The antenna element of claim 21, the at least one second waveguide comprising an array of second waveguides mounted directly adjacent the first aperture of the first waveguide.

23. The antenna element of claim 22, the dipole element comprising a means for connecting to a first feed line and a means for impedance matching the dipole element to the first feed line.

24. The antenna element of claim 23, the dipole element comprising a dipole antenna having two metal sections, the means for impedance matching comprising a tapered conductor between the two metal sections of the dipole antenna, the first waveguide comprising a means for connecting to a second feed line and a means comprising a triangular plate for impedance matching the first waveguide to the second feed line.

25. The antenna element of claim 24, the first frequency band and the second frequency band comprising non-overlapping bands of frequencies.

26. The antenna element of claim 25, the means for preventing comprising a dielectric material mounted adjacent each second waveguide.

27. The antenna element of claim 25, the means for preventing comprising a choke mounted adjacent each second waveguide.

28. The antenna element of claim 25, the means for preventing comprising an electric field absorber mounted adjacent each second waveguide.

29. The antenna element of claim 25, the first waveguide and each second waveguide having rectangular cross-sections.

30. The antenna element of claim 29, the rectangular cross-sections of the first waveguide and each second waveguide having one dimension greater than 0.5 wavelength and one dimension less than 0.5 wavelength.

31. The antenna element of claim 30, each second waveguide parallels the first waveguide and parallels the dipole element.

32. The antenna element of claim 17, the first waveguide and each second waveguide having one dimension greater than 0.5 wavelength and one dimension less than 0.5 wavelength.

* * * * *